US005277608A

United States Patent [19]

Oda

[11] Patent Number: 5,277,608

[45] Date of Patent: Jan. 11, 1994

[54] ELECTRICAL CONNECTOR

[75] Inventor: Kenzo Oda, Hadano, Japan

[73] Assignee: The Whitaker Corporation, Wilmington, Del.

[21] Appl. No.: 34,431

[22] Filed: Mar. 19, 1993

[30] Foreign Application Priority Data

Apr. 16, 1992 [JP] Japan ..... 4-096738

[51] Int. Cl.[5] ..... H01R 13/627; H01R 3/00; H01R 13/42

[52] U.S. Cl. ..... 439/188; 200/51.1; 439/489; 439/595

[58] Field of Search ..... 439/188, 489, 595, 597-599; 200/51.09, 51.10

[56] References Cited

U.S. PATENT DOCUMENTS

| | | | |
|---|---|---|---|
| 4,900,267 | 2/1990 | Nagasaka et al. | 439/489 |
| 4,904,196 | 2/1990 | Sueyashi et al. | 439/188 |
| 5,066,244 | 11/1991 | Kato et al. | 439/489 |
| 5,102,349 | 4/1992 | Kato et al. | 439/489 |
| 5,112,246 | 5/1992 | Kawase et al. | 439/188 |
| 5,127,848 | 7/1992 | Taguchi | 439/188 |
| 5,131,845 | 7/1992 | Taguchi et al. | 439/489 |
| 5,145,356 | 9/1992 | Minnis | 439/188 |
| 5,174,786 | 12/1992 | Kato et al. | 439/489 |

FOREIGN PATENT DOCUMENTS 3-29896 6/1991 Japan .

*Primary Examiner*—Paul A. Bradley
*Attorney, Agent, or Firm*—Timothy J. Aberle

[57] ABSTRACT

A connector housing assembly (2,4) having a first shunt contact (20) and circuit, and a second shunt contact (50) and circuit arranged in a first connector housing (8). A second connector housing (6) includes a contact cancelling part (58) for engagement with the first shunt contact (20) thereby opening the first circuit, and a fitting detecting contact (52) for engagement with the second shunt contact (50). The first shunt circuit is opened before the second shunt circuit is made.

10 Claims, 6 Drawing Sheets

ELECTRICAL CONNECTOR

The instant invention provides an electrical connector that can prevent the connected electronic circuit from malfunctioning due to a current induced unexpectedly while the contacts are open, by providing a short contact that shorts the contacts accommodated in the insulated housing. Additionally, it relates to an electrical connector that is provided with a double lock part to prevent the contacts from being pulled out.

BACKGROUND OF THE INVENTION

In the past, electrical connectors for air bag devices of automobiles, such as is disclosed in Japanese Utility Model No. 3-29896, for example, are known. The prior electrical connector is provided with a short contact which short-circuits the contacts while they are in the open state so that even if a current is unexpectedly induced in the contacts during inspection or assembly of the air bag device, this will not cause malfunctioning of the air bag. The known short contact is in contact with a multiplicity of contacts that are short-circuited when the electrical connector that contains them is separated from the other mating half of the electrical connector. When the electrical connector is fitted together with the mating electrical connector, the short contact is elastically deformed by a contact-canceling part provided in the mating electrical connector so that it no longer touches the short-circuited contacts. Therefore, it is necessary to provide a space that allows the displacement of the short contact inside the insulated housing in which it is placed.

Generally, the contacts accommodated inside the insulated housing are secured by a securing part provided inside the insulated housing. But in situations where the connector will be exposed to a normally vibrating state, like the electrical connectors used in the engine compartment of an automobile, for example, more reliable prevention of contact separation is required. To effect this more reliable prevention of contact separation, electrical connectors equipped with a double lock part that secures the contacts, in addition to the contact securing part inside the insulated housing, are known.

The aforementioned double lock part includes a type that is inserted from the rear end of the insulated housing in the longitudinal direction of the contacts that are accommodated inside the insulated housing, and a type that is inserted into the insulated housing from the side, almost perpendicular to the longitudinal direction of the contacts. But, in recent years, the use of a side-insertion type double lock part has been required because this type can prevent separation in a reliable and highly trustworthy manner.

Providing a double lock part of the aforementioned side-insertion type is required even in the case of the above-mentioned electrical connectors used in the air bag device of automobiles. But, in the past, space limitations made it difficult to provide a double lock part in a way that did not interfere with the short contact, which contact requires a space that permits its displacement as indicated above.

In view of the above problems, the object of the present invention is to provide an electrical connector with a short contact in which a double lock part of the side-insertion type can be easily provided.

SUMMARY OF THE INVENTION

To solve the above problems, the electrical connector of this invention is characterized by comprising:

- an insulated housing that has an accommodating part in which a multiplicity of contacts are accommodated;
- a short contact that is placed in the insulated housing adjacent to the accommodating part and that touches at least two of the multiplicity of contacts, thereby short circuiting them; and
- a double lock part that is provided for insertion in the insulated housing from the side on which the short contact is provided with respect to the accommodating part and which has a securing part that secures the contacts accommodated in the accommodating part in this inserted position and a space that permits displacement of the short contact away from the contacts.

In the construction of the electrical connector of the instant invention, the double lock part is inserted into the insulated housing from the side where the short contact is provided. Also, a space that permits displacement of the short contact away from the short-circuited contacts is provided in the double lock part. Therefore, the double lock part can be placed in a location where it does not interfere with the short contact and that also overlies the position of the short contact. Consequently, whereas in the past it was difficult to provide a double lock part of the side insertion type in an electrical connector equipped with a short contact due to space limitations, the electrical connector of this invention makes it possible to place the short contact and double lock part in a superposed positional relationship, which minimizes the space limitation when providing a double lock part.

DESCRIPTION OF THE PREFERRED EMBODIMENT(S)

Figure 1:
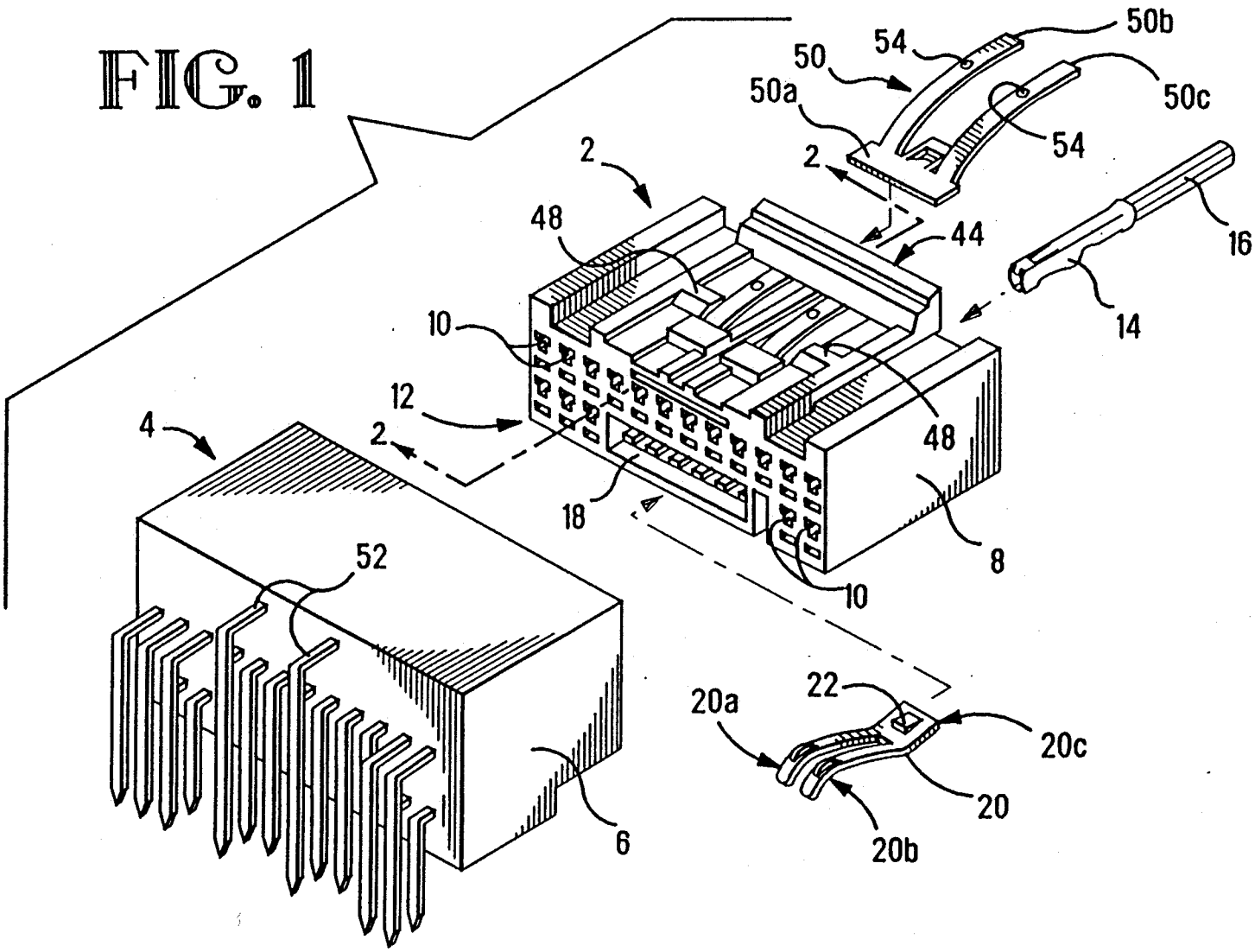
FIG. 1 is an oblique view schematically showing the overall structure of the electrical connector of one embodiment of this invention.
Figure 2:
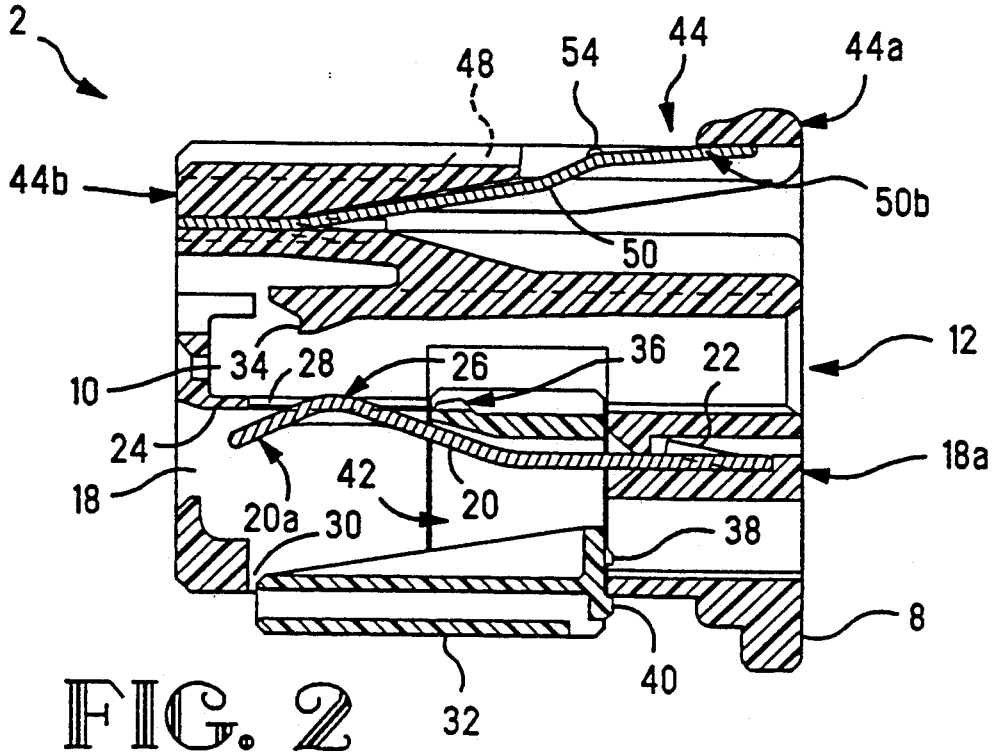
FIG. 2 is a longitudinal section that shows the cross-sectional structure of the above electrical connector.

As shown in FIG. 1, the electrical connector 2 has an insulated housing 8 of the insertion type that is fitted into an acceptor type insulated housing 6 of another electrical connector 4. As shown in FIG. 2, the insulated housing 8 has a contact accommodating part 12 composed of a multiplicity of contact accommodating compartments 10 that go all the way through the insulated housing 8 in the insertion direction. The contact accommodating compartments 10 are aligned in two levels, upper and lower, inside the insulated housing 8. Female contacts 14 connected to signal conductors 16 on the air bag device side are respectively accommodated in the contact accommodating compartments 10.

As shown in FIG. 1, a short-contact-accommodating compartment 18 that adjoins each of the contact accommodating compartments 10 is provided on the lower level side of six of the contact accommodating compartments 10 in the center of the upper level. When the above-mentioned female contacts 14 are accommodated inside the six contact accommodating compartments 10, three short contacts 20 that short-circuit three groups of two adjoining female contacts 14 are accommodated inside the short-contact-accommodating compartment 18. Each of these short contacts 20 is formed from a thin piece of conductive metal and has a pair of elastic contact pieces 20*a* and 20*b* that extend from the base 20*c* in a forked manner, as shown in FIG. 1. Base 20*c* includes a securing claw 22. As shown in FIG. 2, the short contacts 20 are inserted into a short contact support 18*a* formed in the short-contact-accommodating compartment 18 so that the support part 18*a* and securing claw 22 engage each other, holding the short contacts inside the short-contact-accommodating compartment 18. As is well illustrated in FIG. 2, the aforementioned elastic contacting piece 20*a* (20*b*) of the short contact 20 has been bent in a chevron shape pointing upward. In the partition 24 that separates the contact accommodating compartments 10 and the short-contact-accommodating compartment 18 there is provided an advancing hole 28 so that part of the top 26 of the elastic contacting piece 20*a* (20*b*) can advance into the contact accommodating compartment 10.

Figure 3:
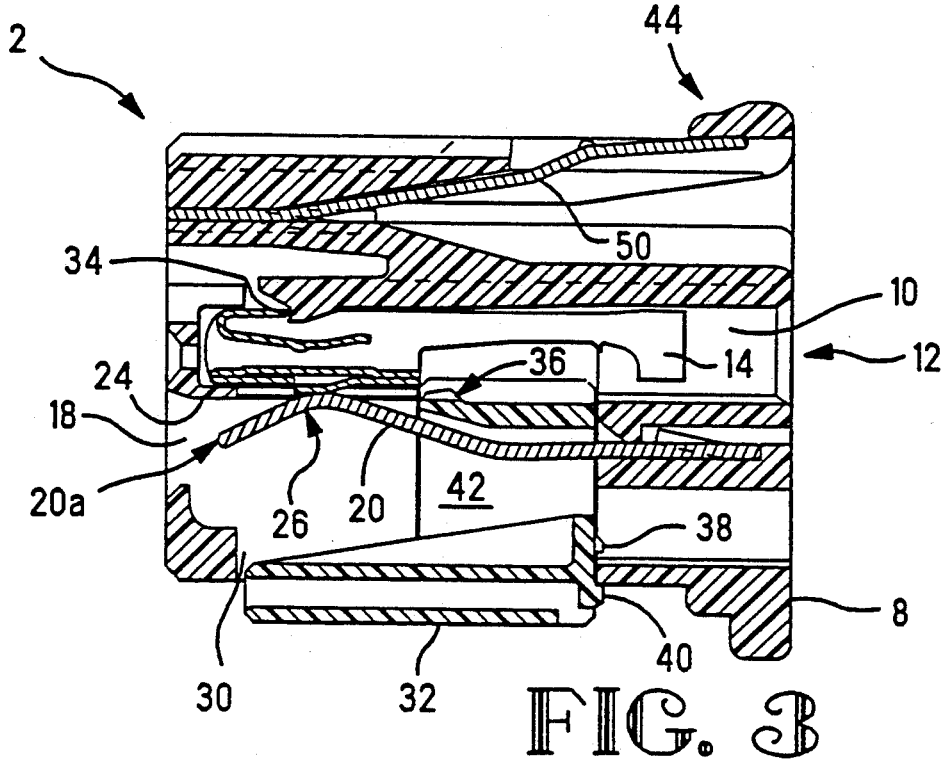
FIG. 3 is a longitudinal view showing the cross-sectional structure of the above electrical connector in a state where the contacts are accommodated and the double lock part is inserted up to the pre-securing position.
Figure 9:
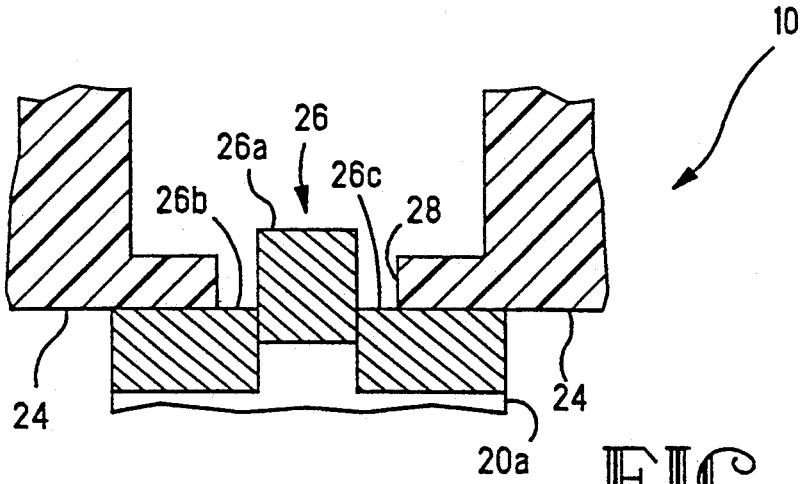
FIG. 9 is a cross-section shown at line A—A of FIG. 2.

The construction of the peak 26 of the elastic contacting piece 20*a* (20*b*) of the short contact 20 will now be discussed in further detail while referring to FIG. 9. FIG. 9 is a view of the cross section from line A—A in FIG. 2. As shown in FIG. 9, the peak 26 is composed of a contacting surface 26*a*, which advances into the contact accommodating compartments 10 and which is formed by bending the aforementioned elastic contacting piece 20*a* (20*b*) after slitting it for a specified length in its longitudinal direction, and contact-causing surfaces 26*b*, 26*c* that contact with the lower surface of the aforementioned partition 24. The contacting surface 26*a* contacts the female contacts 14 accommodated in the contact accommodating compartments 10, thereby short-circuiting two adjacent female contacts 14 (see FIGS. 3 and 4). But in this practical embodiment the elastic contacting pieces 20*a* (20*b*) have been bent so that a specified pressing force acts on the lower surface of partition 24 from the contact-causing surfaces 26*b*, 26*c* at the point in time that the short contact 20 is set in the short-contact-accommodating compartment 24 (as shown in FIG. 2). This enables the contacting surface 26 to make contact with the female contacts 14 more reliably.

Figure 11:
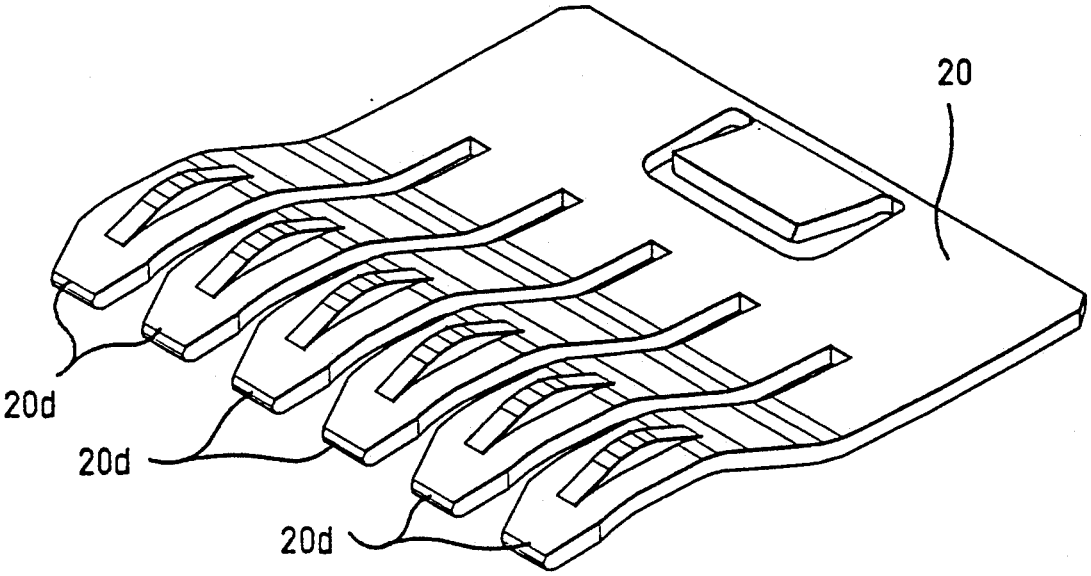
FIG. 11 is an oblique view showing an example of the deformation of the short contact of the electrical connector according to the instant invention.

In this embodiment, as shown in FIG. 1, each short contact 20 is made in a forked shape with a pair of elastic contacting pieces 20*a*, 20*b*. Each of these short contacts 20 short-circuits two adjacent female contacts 14 among the six female contacts accommodated in the six contact accommodating compartments 10 in the center of the upper level. However, the short contact 20 may be made in a form having six elastic contacting pieces 20*d* as shown in FIG. 11 so that it shorts all six female contacts 14 at the same time. Here, FIG. 11 is an oblique view showing an example of the deformation of the short contact 20 in this practical embodiment.

Also, as shown in FIG. 2, the electrical connector 2 has a double lock part 32 that is inserted inside the insulated housing 8 from the bottom of the side of insulated housing 8 where the insertion hole 30 is formed, that is, from the side where the short contact 20 is provided with respect to the contact accommodating compartments 10. Together with the elastic securing part 34 formed in the upper wall of the contact accommodating compartments 10, this double lock part 32 doubly secures the female contacts 14 when they are accommodated in the contact accommodating compartments 10. The double lock part 20 has a securing part 36 that secures the female contacts 14 received in the contact accommodating compartments 10. The securing part 36 is formed by a wall that extends continuously in the width direction (perpendicular to the plane of FIG. 2) of the double lock part 32, thereby enhancing its strength.

On the bottom part of the rear end of the double lock part 32 are formed a pre-securing protrusion 38, and a full securing protrusion 40. A double lock part 32 is inserted into the insulated housing 8 up to the pre-securing position shown in FIG. 2, where the pre-securing protrusion 38 temporarily engages the insulated housing 8. In the state where the double lock part 32 is inserted to this presecuring position, the securing part 36 does not advance into the contact accommodating compartments 10. In this state, the female contacts 14 are inserted inside the contact accommodating compartments 10 (see FIG. 3), and when the double lock part 32 is subsequently inserted into the insulated housing 8 up to the full securing position where the full securing projection 40 engages with the insulated housing 8, the securing part 36 advances into the contact accommodating compartments 10, securing the female contacts 14 (see FIG. 4).

Figure 4:
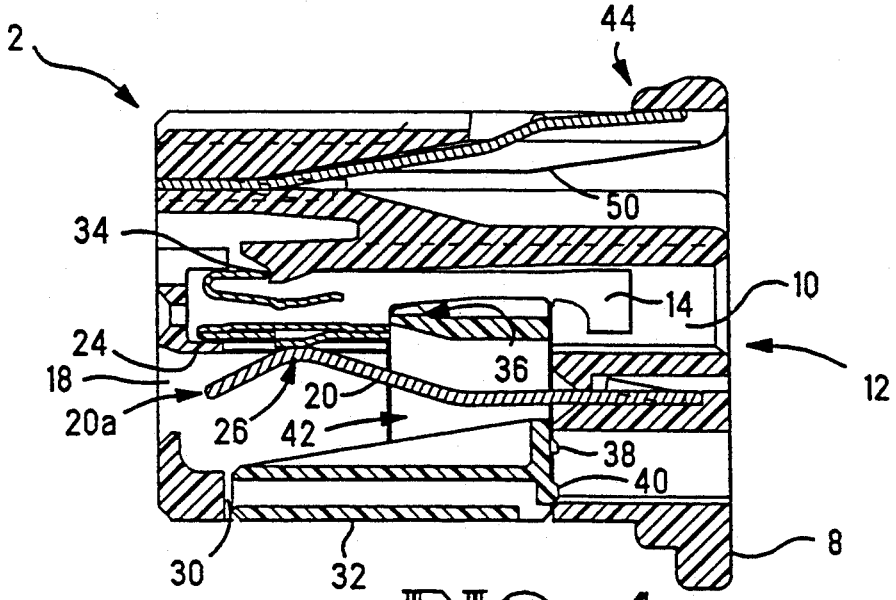
FIG. 4 is a longitudinal section showing the cross-sectional structure of the above electrical connector in a state where the contacts are accommodated and the double lock part is inserted to the full securing position.

The double lock part 32 also has a space 42 that passes through the double lock part 32 in the left-to-right direction of FIG. 4 at a location corresponding respectively to the locations of each short contact 20. When assembling the device, the double lock part 32 is first inserted into the insulated housing 8 up to the presecuring position shown in FIG. 2. Then, the short contact 20 is inserted through this space and set inside the insulated housing 8. The space 24 also becomes part of a recess so that it does not interfere with short contact 20 when it moves between the presecuring position and the full securing position in the double lock part 32. As will be discussed later, space 24 permits displacement of the short contact 20 when the short contact 20 is separated from the female contacts 14 which it normally touches when the double lock part 32 is in the full securing position.

Providing the space 42 in the double lock part 32 in this way makes it possible to place the double lock part 32 in a position that overlies the short contacts 20 and does not interfere with the short contacts. Thus, it becomes easy to provide a double lock part 32 in an electrical connector that has a short contact. Also, in this embodiment, the short contact 20 is inserted into the space 42 after presecuring the double lock part 32, so the double lock part 32 does not come loose from the insulated housing 8 during transport.

Figure 5:
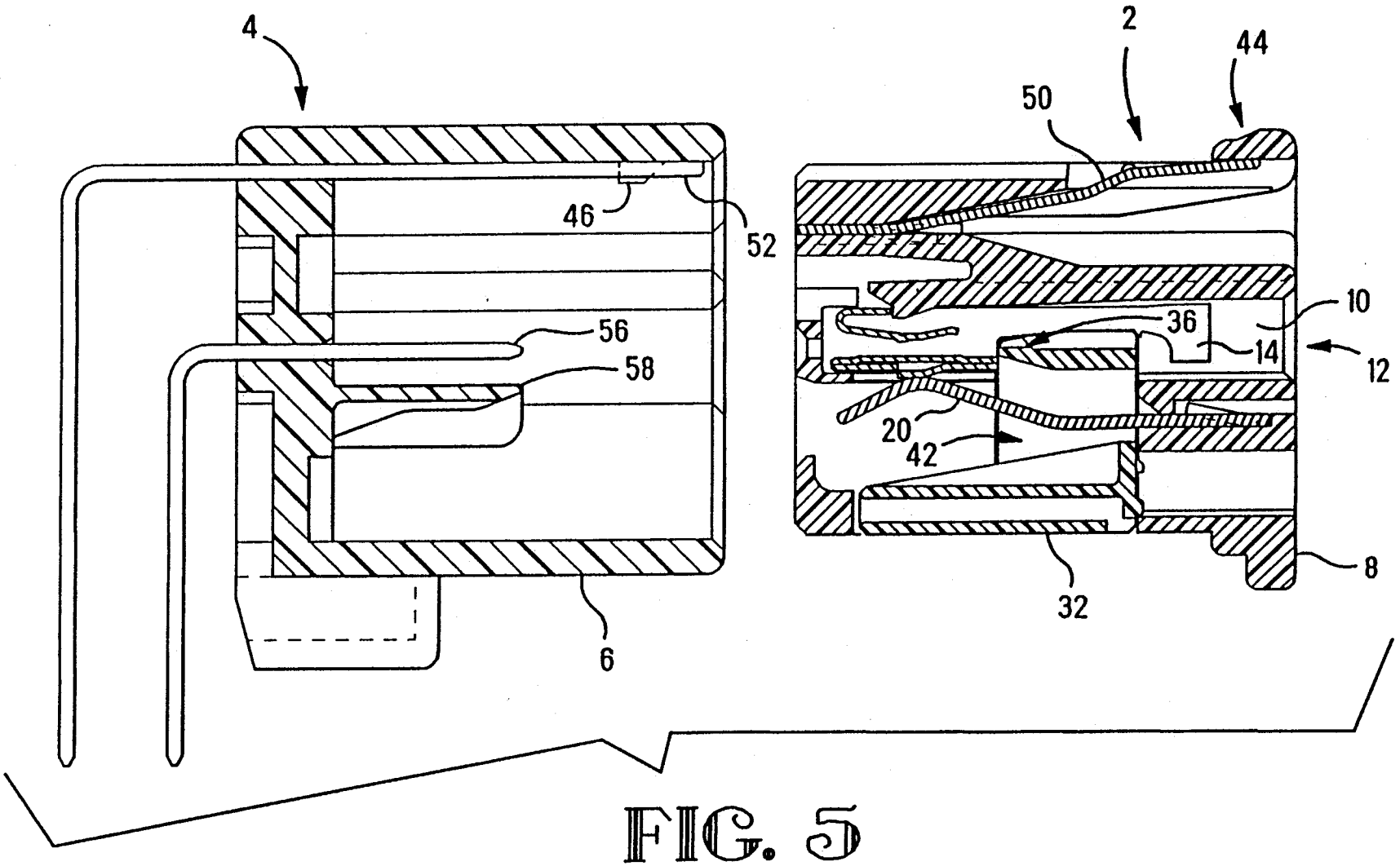
FIG. 5 is a longitudinal section showing the cross-sectional structure of the above electrical connector in a state before it is fitted to the other electrical connector.

Additionally, an elastic fitting lever 44 that effects connection to and disconnection from the other electrical connector 4, is provided in the upper surface of the insulated housing 8 as shown in FIG. 1. As shown in FIG. 2, the elastic fitting lever 44 is an elastic part that extends from the side of the insulated housing 8 that fits together with the other electrical connector 4 in a cantilever fashion. It has a fitting step 48 that cooperates with a fitting projection 46 formed on the inner surface of the insulated housing 6 of the other electrical connector 4 (see FIG. 5). Additionally, it is constructed so that the connection can be canceled by pressing its front end 44*a* when the fitting step 48 and the fitting projection 46 on the other side are fitted together. Here, FIG. 5 is a longitudinal section that shows the above electrical connector in the state just before it is connected to the other electrical connector.

As also shown in FIG. 1, on the lower side of the elastic fitting lever 44 is provided a detecting part 50 that lies along the elastic fitting lever 44. This fitting detecting part 50 has a base 50*a* and elastic detecting pieces 50*b*, 50*c* that extend in a forked manner. As shown in FIG. 2, the base 50*a* is fitted into the fixed end 44*b* of the aforementioned elastic fitting lever 44, and it is placed so that the front ends of the elastic detecting pieces 50*b*, 50*c* which causes contact from the lower side with the front end 44*a* of the elastic fitting lever 44. In addition, the fitting detecting part 50 has been bent so that it forces the end 44*a* of the elastic fitting lever 44 upward. This increases the fitting force of the elastic fitting lever 44 and at the same time prevents the elastic fitting lever 44 from being deformed by exposure to severe service situations such as high temperatures and vibration.

Figure 10:
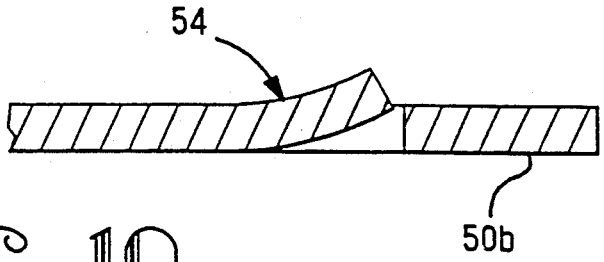
FIG. 10 is a cross section shown at line B—B of FIG. 2.

The fitting detecting part 50 is provided so that complete fitting of the insulated housing 8 to the other insulated housing 6 will be confirmed by the fact that the fitting detecting part 50, and a fitting detecting contact 52 provided in the other insulated housing 6, (see FIG. 5) are in contact. In the upper surface of elastic detecting pieces 50*b*, 50*c* of the fitting detecting part 50 is formed a contacting part 54 that contacts the fitting detecting contact 52 in the complete fitting state. The contacting part 54, as shown in FIG. 10, is formed by cutting part of the aforementioned elastic contacting pieces 50*b*, 50*c* and bending that part upward. This results in the contacting part 54 making contact with the fitting detecting contact 52 at virtually one point, so its contact sensitivity and durability are improved. Here, FIG. 10 is an enlarged view of the cross section at line B—B of FIG. 2.

Figure 6:
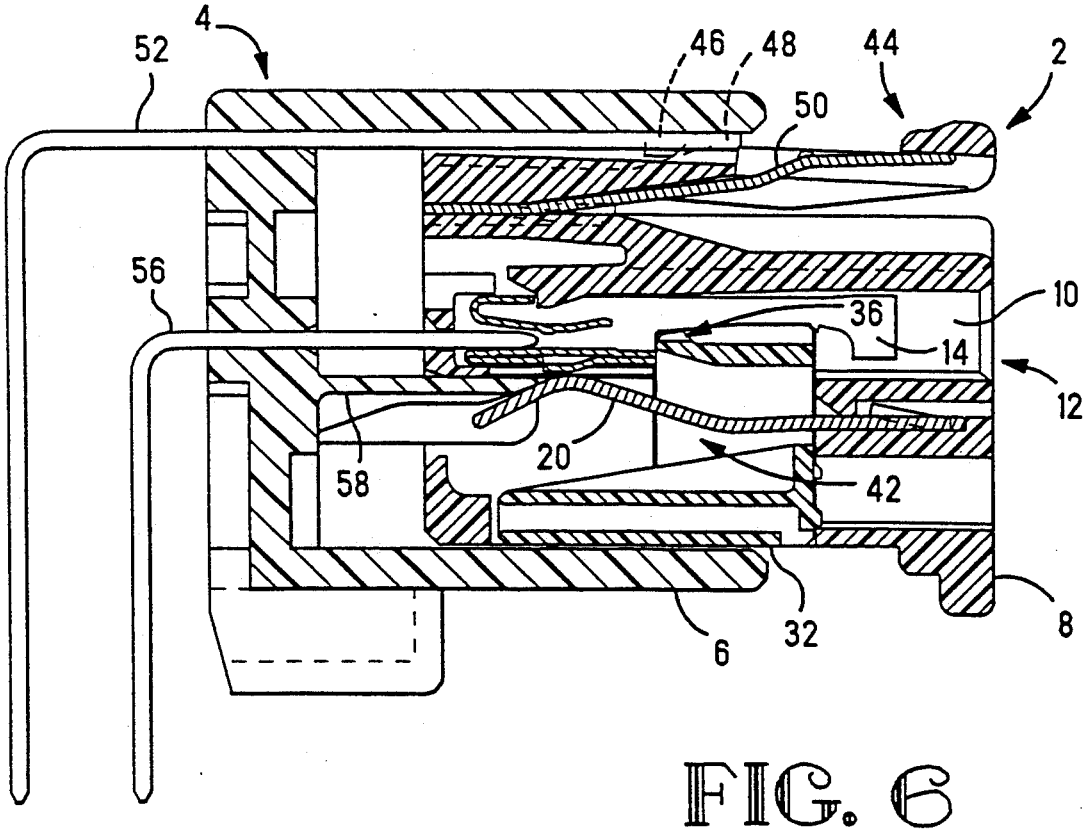
FIG. 6 is a longitudinal section showing the cross-sectional structure of the above electrical connector in a state where it is only slightly fitted to the other electrical connector.
Figure 7:
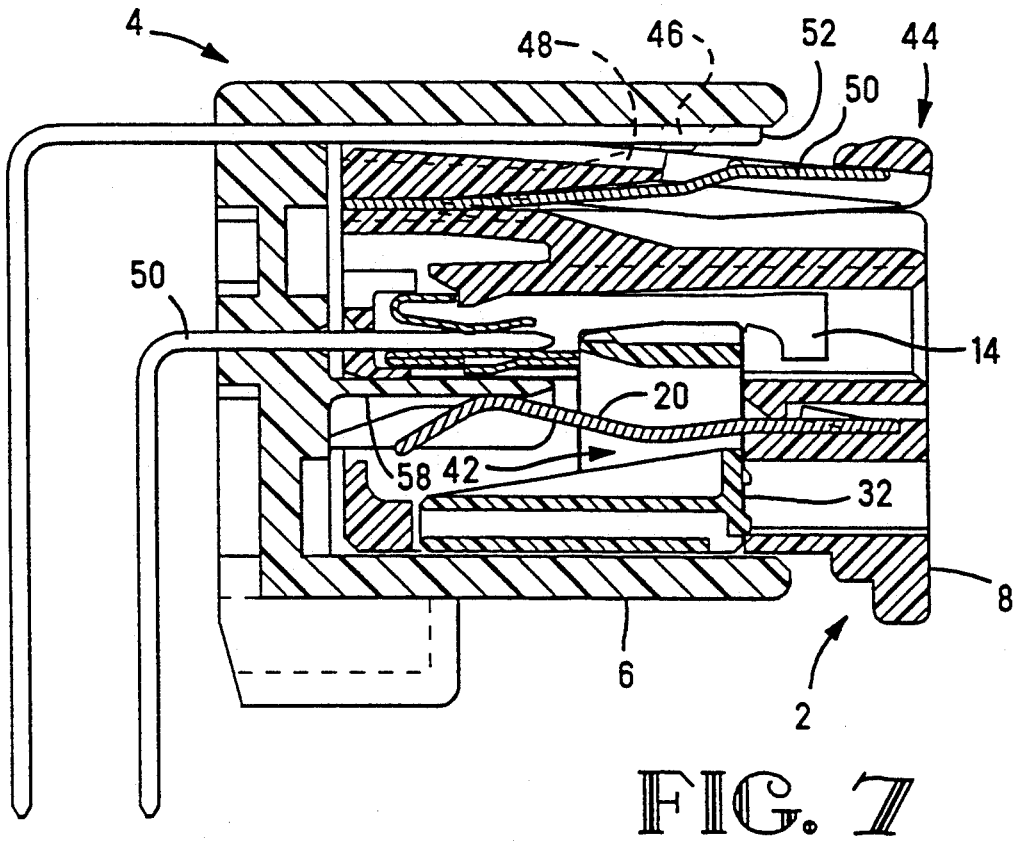
FIG. 7 is a longitudinal section showing the cross-sectional structure of the above electrical connector in a state where it is half-way fitted to the other electrical connector.
Figure 8:
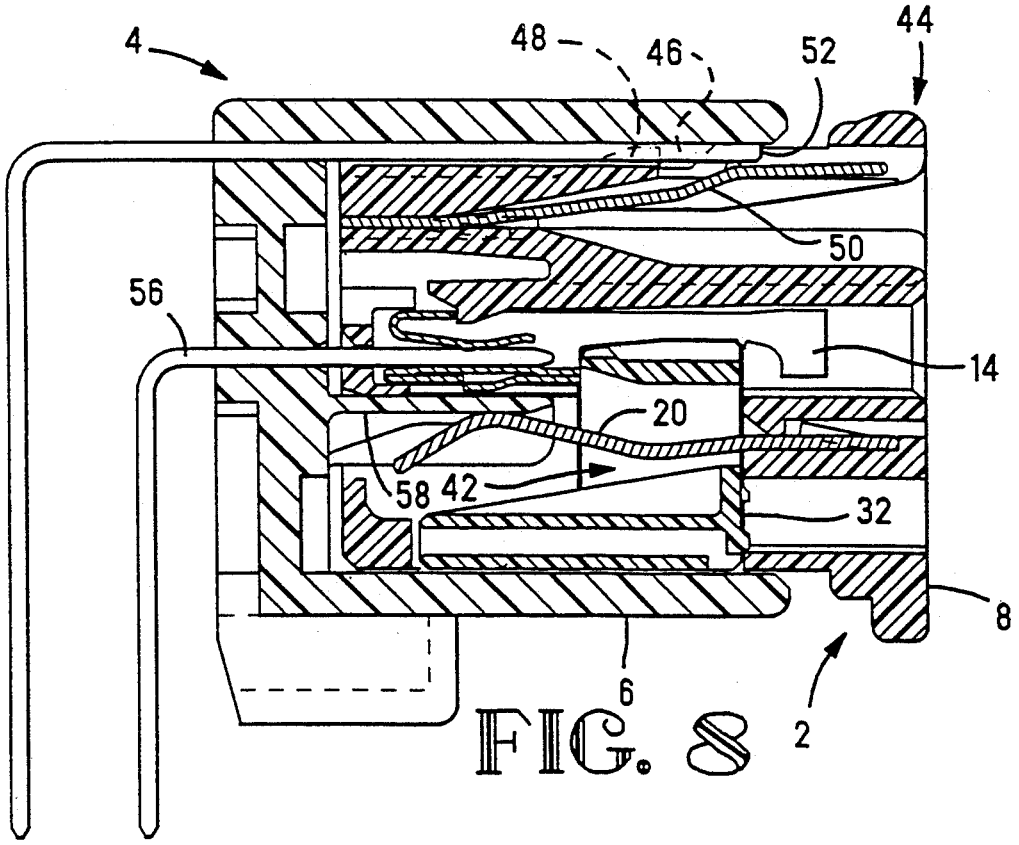
FIG. 8 is a longitudinal section that shows the cross-sectional structure of the above electrical connector in a state where it is fully fitted to the other electrical connector.

Further explanation will now be given while referring to FIGS. 6–8. FIG. 6 is a longitudinal section that shows the electrical connector 2 in a state in which it is only slightly fitted to the other electrical connector 4. FIG. 7 is a longitudinal section that shows the electrical connector 2 in a state in which it is half-way fitted to the other electrical connector 4. FIG. 8 is a longitudinal section that shows the electrical connector 2 in a state in which it is completely fitted to the other electrical connector 4.

As shown in FIG. 5, in the other insulated housing 6 are provided a pin-shaped male contact 56 and a contact canceling part 58 that extends almost parallel with this male contact 56. As shown in FIGS. 6–8, when the two insulated housings 6, 8 are fitted together, the contact canceling part 58 is forced in between the elastic contacting piece 20*a* (20*b*) of the short contact 20 that was in contact with the female contacts 14, canceling their short-circuited state. At this time the short contact 20 is displaced in a direction away from the female contacts 14 (downward in the drawing), but, as discussed above, the connector is constructed so that the space 42 of the double lock part 32 permits this displacement.

As also discussed above, the fitting detecting part 50 and fitting detecting contact 52 are not in contact with each other until the fitting step 48 of the fitting lever 44 and the fitting protrusion 46 are not engaged, as shown in FIG. 7. But when the fitting step 48 and fitting protrusion 46 are fitted together as shown in FIG. 8, contact 52 and part 50 make contact with each other. This makes it possible to detect whether the insulated housings 6, 8 are completely connected to each other.

A practical embodiment of the electrical connector of this invention has been described above, but the electrical connector of this invention is not limited to this mode. For example, the electrical connector 2 of the above embodiment is shipped from the plant as a product with the female contacts 14 not accommodated (i.e., in the state shown in FIG. 2), but the electrical connector of this invention may be shipped as a product with the contacts accommodated (i.e., in the state shown in FIG. 4).

Of course, this invention can also be applied to electrical connectors used for purposes other than air bag devices for automobiles.

I claim:

1. An electrical connector assembly comprising matable first and second connector housings:

said first connector housing having a first shunt contact for maintaining a first shunt circuit when said connector housings are in an unmated state, and a second shunt contact for maintaining a second shunt circuit when said connector housings are in a mated state;

said second connector housing including a shunt interface member for engaging and opening said first shunt contact in the mated state, and a fitting detecting contact for engagement with said second shunt contact when said connector housings are in the mated state;

whereby, said first shunt circuit is opened before said second shunt circuit is made when said housings are moved from the unmated to the mated state.

2. The electrical connector assembly of claim 1, wherein the first connector housing includes a double lock member having a cavity through which the first shunt contact passes.

3. The electrical connector assembly of claim 1, wherein the first connector housing includes a terminal receiving passageway with a wall having an aperture therein, said first shunt contact having a raised edge which projects through said aperture into said passageway for engagement with an electrical contact.

4. The electrical connector assembly of claim 1, wherein the first connector housing includes a fitting lever which engages the second shunt contact and is thereby resiliently biased for upward and downward cantilever action as said housings are mated and unmated.

5. The electrical connector assembly of claim 4, wherein the fitting lever includes a fitting step means for engagement with said second housing and for downward cantilever movement of the fitting step against the biasing force of the second shunt contact.

6. An electrical connector assembly having matable first and second connector housings, the second connector housing including a shunt interface member for cooperating with the first connector housing as the housings are urged toward the mated state, said first housing comprising:

a first shunt contact for maintaining a first shunt circuit when said connector housings are in an unmated state, and a second shunt contact for maintaining a second shunt circuit when said connector housings are in a mated state;

whereby, said first shunt circuit is opened before said second shunt circuit is made when said housings are moved from the unmated to the mated position.

7. The electrical connector assembly of claim 6, wherein the first connector housing includes a double lock member having a cavity through which the first shunt contact passes.

8. The electrical connector assembly of claim 6, wherein the first connector housing includes a terminal receiving passageway with a wall having an aperture therein, said first shunt contact having a raised edge which projects through said aperture into said passageway for engagement with an electrical contact.

9. The electrical connector assembly of claim 6, wherein the connector housing includes a fitting lever which engages the second shunt contact and is thereby resiliently biased for upward and downward cantilever action as said housings are mated and unmated.

10. The electrical connector assembly of claim 9, wherein the fitting lever includes a fitting step means for pressing engagement with said second housing, and for downwardly directed cantilever movement of the fitting step against the upwardly directed biasing force of the second shunt contact.

* * * * *